United States Patent [19]

Debrodt et al.

[11] Patent Number: 4,849,085

[45] Date of Patent: Jul. 18, 1989

[54] ANODES FOR ELECTROLYSES

[75] Inventors: Heiner Debrodt, Meckenheim; Petra Kluger, Neusäss, both of Fed. Rep. of Germany

[73] Assignee: Ciba-Geigy Corporation, Ardsley, N.Y.

[21] Appl. No.: 41,888

[22] Filed: Apr. 22, 1987

[30] Foreign Application Priority Data

Apr. 25, 1986 [DE] Fed. Rep. of Germany ..... 3613997

[51] Int. Cl.[4] ..... C25B 11/00

[52] U.S. Cl. ..... 204/290 F; 204/280

[58] Field of Search ..... 204/290 F, 280, 242

[56] References Cited

U.S. PATENT DOCUMENTS

| | | | |
|---|---|---|---|
| 3,926,773 | 12/1975 | Koziol et al. | 204/290 |
| 4,013,525 | 3/1977 | Emsley | 204/290 F |
| 4,029,566 | 6/1977 | Brandmair et al. | 204/290 |
| 4,138,510 | 2/1979 | Koziol et al. | 427/124 |
| 4,140,615 | 2/1979 | Kadija et al. | 204/266 |
| 4,140,813 | 2/1979 | Hund et al. | 427/34 |
| 4,288,302 | 9/1981 | de Nora et al. | 204/105 R |
| 4,297,195 | 10/1981 | Sato et al. | 204/290 |
| 4,302,321 | 11/1981 | de Nora et al. | 204/291 |
| 4,392,927 | 7/1983 | Fabian et al. | 204/98 |

FOREIGN PATENT DOCUMENTS

| | | | |
|---|---|---|---|
| 2714488 | 10/1977 | Fed. Rep. of Germany | 204/290 F |
| 3208835 | 11/1982 | Fed. Rep. of Germany | . |
| 1233590 | 5/1971 | United Kingdom | . |

*Primary Examiner*—John F. Niebling
*Assistant Examiner*—Kathryn Gorgos
*Attorney, Agent, or Firm*—Harry Falber; Stephen V. O'Brien; Luther A. R. Hall

[57] ABSTRACT

An anode for aqueous electrolyses, consisting of a frame or support and a porous substrate which is connected to the frame and in which electrochemically active substances are dispersed. The substrate consists of titanium which is doped with chromium or nickel.

4 Claims, No Drawings

ANODES FOR ELECTROLYSES

The invention relates to an anode for aqueous electrolyses, consisting of a frame which is resistant to the electrolyte and to the electrolysis products, a titanium-containing porous susbstrate firmly connected to the frame, and electrochemically active substances which are distributed in the pores of the substrate.

In chloralkali electrolysis and other electrolyses using aqueous electrolytes, metal anodes have long been used which essentially contain a frame or a base of a metal capable of passivation, on which one or more electrochemically active substances are firmly anchored. Because of its availability and the comparatively low price, it is usual to use titanium frames, which are resistant to the electrolyte and to the electrolysis products. Preferred electrochemically active substances are oxides of metals of the platinum group, alone or as a mixture with other metal oxides, spinels, perovskites and other mixed oxides. For specific electrolyses, coatings which do not contain any platinum metal oxides have also been disclosed. The life of the coated anodes is essentially determined by the resistance of the electrochemically active coating, which depends on the type of substance and the electrolysis conditions, the adhesion to the metal frame and, in the chloralkali electrolysis in mercury cells, also on the stability in contact with mercury. Many proposals for prolonging the anode life have been disclosed, the intention of these proposals being to safeguard the active substance from damage by shortcircuit, to improve their anchoring to the titanium frame and finally to provide as large an amount as possible of the electrochemically active substance. Common to these proposals are porous support layers or substrates which are firmly connected to the frame and accept the electrochemically active substance. The porous substrate is a better adhesive base than the more or less smooth surface of the frame, it protects the active substance during shortcircuits, and its absorption capacity can be widely adapted to the requirements of the electrolysis, via the porosity and thickness of the substrate.

According to German Pat. No. 2,300,422, the substrate consists of various titanium oxides, which are applied to the anode frame in an amount of 100 to 6000 $g/m^2$ by flame spraying or plasma spraying. Oxides having the composition $TiO_{2-x}$, with $0.1>x>0$, are said to exhibit particularly advantageous behavior. The porous substrate is impregnated with a solution containing salts of the platinum metals, which are thermally decomposed after evaporation of the solvent. It has also been disclosed that the electrochemically active substance can be applied to the surface of the anode frame together with oxides, nitrides, phosphides, borides or carbides of a metal from the group consisting of the metals capable of passivation, preferably with titanium dioxide, in a single operation (European Offenlegungsschrift No. 0,058,832). Another anode has a substrate which, in addition to titanium oxides, contains oxides of other non-noble metals, such as niobium oxide or nickel oxide (German Offenlegungsschrift No. 3,208,835). Compounds of at least one element of the platinum group are added to the substrate applied by flame spraying. Finally, a substrate has been disclosed which consists of a sintered layer of titanium oxides having the composition $TiO_x$, with $0.25<x<1.50$ (German Offenlegungsschrift No. 2,412,828). The porous substrate disclosed in German Offenlegungsschrift No. 2,035,212 and sintered onto the support frame consists of metallic titanium.

During electrolysis, all substrate layers form electrically nonconductive oxides at the interface between the frame, which generally consists of metallic titanium, and the base of the substrate, which cause progressive passivation of the anode during the operating time and may even cause detatchment of the substrate layers. Finally, the passivating layer is also the reason why the entire substrate has to be removed prior to reactivation of the passivated anode, nobel metals being lost. To prevent passivation, it has been proposed that a particular intermediate layer be arranged between the metallic frame and the substrate containing the chemically active substances, the said intermediate layer consisting of mixed oxides having valencies of 4 and 3, and platinum dispersed in the oxides (German Offenlegungsschrift No. 2,936,033). These anodes have a comparatively long life, but their technically complicated production is a disadvantage.

There is a need for a substrate for absorbing electrochemically active substances which is easy to produce, constitutes a good adhesive base for the substances, safeguards them against shortcircuits and, when used as an oxygen-forming anode, substantially retards the formation of a passivating layer and can be reactivated with little effort.

The invention relates to an anode for aqueous electrolyses, consisting of a frame which is resistant to the electrolyte and to the electrolysis products, a titanium-containing porous substrate which is connected to the frame, and electrochemically active substances which are distributed in the pores of the substrate, where the porous titanium-containing substrate is doped with a metal from the group consisting of chromium and nickel.

The invention is based on the surprising discovery that, under the conditions of aqueous electrolyses, titanium doped with chromium and/or nickel transports the current in the direction of the anode too, even when the said titanium does not contain any electrochemically active substances. Passivation is greatly reduced compared with substrates consisting of titanium or other passivatable metals or valve metals. Virtually no detatchment of metal from the anode is observed. The character of the layer according to the invention is comparable with that of a noble metal.

The amount of doping elements added to the titanium can be, for example, 0.5 to 40% by weight and is preferably 2 to 20% by weight, in particular 2 to 10% by weight. Below about 2%, the effect of doping is small, while above 20% partial dissolution of the doping metals may take place under the conditions relevant to oxygen-evolving anodes. To prepare the doped substrate, for example, chromium and/or nickel in the form of fine powder can be mixed with pulverulant titanium, and the mixture applied to the frame, for example by flame spraying. Under these conditions, mixed crystals of titanium and the doping metal are formed only to a limited extent. In another process, the powder mixture to which a temporary binder has been added is sprayed onto the frame or painted on with a brush, and a porous sintered layer firmly bonded to the frame is formed by heating in an inert atmosphere. During sintering, mixed crystals may form in a relatively large amount, but are thermodynamically unstable at room temperature and, therefore, decompose on cooling. The functionality of the doped substrates is virtually completely independent of the various preparation processes.

The thickness of the substrate is preferably 0.2 to 1 mm. The porosity can be, for example, 20 to 60 vol-%, in particular 30 to 50 vol-%. For an average porosity of about 40 vol-%, the substrate has an absorption capacity for the electrochemically active substances which is appropriate for the known aqueous electrolyses. To incorporate the active substances, the substrate can be impregnated with solutions or suspensions which contain these substances. The type of electrochemically active substances used is determined in a known manner by the electrolysis conditions. Suitable substances include platinum metals, oxides of platium metals, spinels, perovskites and β-manganese dioxide, alone or in the form of mixtures.

Anodes according to the invention are suitable in particular for the chloralkali electrolysis and for electrolyses in which oxygen is anodically produced. The anodes have a long life and their reactivation is particularly simple, since apparently no electrically non-conductive oxides are formed during the electrolysis. After cleaning, for example by means of a steam jet, the anode is reactivated by introducing electrochemically active substances into the porous substrate.

The invention is illustrated below by means of examples:

EXAMPLE 1

Titanium sheets are degreased, sand-blasted and coated with a fine-particled mixture of titanium and chromium powder. The mixture contains 9% by weight of chromium and 91% by weight of titanium (maximum particle size 0.1 mm) and is kneaded with an aqueous tylose solution to give a sprayable paste. A 0.5 mm thick layer is applied to the sheets, using a flow cup gun; the sheets are dried at room temperature, and the porous substrate layer which adheres firmly to the sheets and whose porosity is about 25 vol-% is produced by heating to 1200° C. in argon.

The sheets are divided into sections measuring 50×100 mm, and the substrate layers are impregnated with electrochemically active substances as follows:

(a) a 40% aqueous solution of manganese (II) nitrate is applied to the porous substrate, and, after drying, the anode is heated to 300° C. to decompose the salt (residence time 10 minutes). After this process has been repeated five times, the anode contains about 300 g/m² of $\beta$-$MnO_2$.

(b) The substrate is impregnated with a solution containing 48.17 mg of $H_2IrCl_6$, 37.27 mg $TaCl_5$ and 278.2 mg of ethanol, and is heated to 550° C. to decompose the salts (residence time 10 minutes). After the process steps have been repeated four times, the substrate contains 23 g/m² of $IrO_2$ and 2 g/m² of $TaO_2$.

(c) The substrate is impregnated with a solution which contains 1.93 g of $RuCl_3$, 7.23 g of butyl titanate, 1.43 g of HCl and 7.31 g of butanol. The anodes are dried and heated to 520° C., and the process steps are repeated three times. The anode then contains 11.8 g/m² of $RuO_2$ and 21.3 g/m² of $TiO_2$ distributed in the substrate.

For comparison, titanium sheets without substrates and titanium sheets with non-doped substrate layers of porous sintered titanium were coated with the same amounts of the electrochemically active substances, and the life of the anodes in 20% sulfuric acid at room temperature was measured under the same conditions.

TABLE I

| Electrochemically active coating | Life of oxygen-evolving anodes: Current density kA/m2 | Without substrate | Non-doped substrate | Chromium-doped substrate |
|---|---|---|---|---|
| a | 2 | 8 h | 550 h | 1728 h |
| b | 10 | 1074 h | 2701 h | 4000 h |
| c | 2 | 113 h | 210 h | 501 h |

EXAMPLE 2

A substrate layer about 0.4 mm thick and consisting of doped titanium is applied to titanium sheets by flame spraying a mixture containing 9% by weight of nickel powder and 91% by weight of titanium powder. The particle size of the powders is smaller than 0.05 mm. As described in Example 1, the substrate layers are impregnated with solutions a, b and c and tested in comparison with anodes which contain the same amount of electrochemically active substances but no substrate or no doped substrate.

TABLE II

| Electrochemically active coating | Life of oxygen-evolving anodes: Current density kA/m2 | Without substrate | Non-doped substrate | Chromium-doped substrate |
|---|---|---|---|---|
| a | 2 | 8 h | 550 h | 906 h |
| b | 10 | 1074 h | 2701 h | 3607 h |
| c | 2 | 113 h | 210 h | 358 h |

EXAMPLE 3

The passivation rate of various anodes which have no coatings of electrochemically active substances is measured in 20% sulfuric acid at room temperature and at a current density of 0.2 kA/m². Passivation is indicated by an increase in the cell voltage to 10 V.

TABLE III

| Anode | Passivation of oxygen-evolving anodes: Passivation time (h) |
|---|---|
| Titanium sheet without substrate | 0.03 |
| Titanium sheet with non-doped substrate | 0.18 |
| Titanium sheet with substrate, doped with 2% of Cr | 302 |
| Titanium sheet with substrate, doped with 10% of Cr | 410 |
| Titanium sheet with substrate, doped with 50% of Cr | 328* |
| Titanium sheet with substrate, doped with 2% of Ni | 500 |

*Corrosion by dissolution of chromium

We claim:

1. An anode for aqueous electrolyses, consisting of a frame which is resistant to the electrolyte and to the electrolysis products, a titanium porous substrate coated on the frame, and electrochemically active substances which are distributed in the pores of the substrate, wherein the porous titanium substrate is doped with a metal selected from the group consisting of chromium and nickel, the level of dopant is 0.5 to 40% by weight of the substrate and the thickness of the substrate is 0.2 to 1 mm.

2. An anode as claimed in claim 1, wherein the amount of the doping elements is 2 to 20% by weight of substrate.

3. An anode as claimed in claim 2 wherein the porous substrate has a porosity of 20 to 60 volume-%.

4. An anode as claimed in claim 1 wherein the porous substrate has a porosity of 20 to 60 volume-%.

* * * * *